US008449309B1

(12) United States Patent
Mosholder

(10) Patent No.: US 8,449,309 B1
(45) Date of Patent: May 28, 2013

(54) USB PORT PROTECTOR

(75) Inventor: Gary S. Mosholder, Sykesville, MD (US)

(73) Assignee: The United State Government as represented by the Director, National Security Agency, Washington, DC (US)

( * ) Notice: Subject to any disclaimer, the term of this patent is extended or adjusted under 35 U.S.C. 154(b) by 71 days.

(21) Appl. No.: 13/374,640

(22) Filed: Dec. 7, 2011

(51) Int. Cl.
*H01R 13/44* (2006.01)

(52) U.S. Cl.
USPC ..... 439/148; 439/135

(58) Field of Classification Search
USPC ..... 439/148, 149, 135; 361/679.4
See application file for complete search history.

(56) References Cited

U.S. PATENT DOCUMENTS

| | | | | |
|---|---|---|---|---|
| 7,083,438 | B2 | 8/2006 | Massaro et al. | |
| 7,390,201 | B1 | 6/2008 | Quinby et al. | |
| 7,530,824 | B2 | 5/2009 | Bolain | |
| 7,563,113 | B2 | 7/2009 | Sheng | |
| 8,414,314 | B1 * | 4/2013 | Mosholder | 439/148 |
| 2010/0033913 | A1 * | 2/2010 | Cao | 361/679.4 |

* cited by examiner

*Primary Examiner* — Hae Moon Hyeon
(74) *Attorney, Agent, or Firm* — Robert D. Morelli

(57) ABSTRACT

A Universal Serial Bus port protector having a top piece and a tongued planar surface, where the top piece includes a rectangular surface, a rectangular planar surface, a box having an open bottom and an open top, and a shim-like piece, and where the tongued planar surface includes a tongued portion and an untongued portion, where the tongued portion includes one dado and two rabbet cuts and two projections, where the top piece and the tongued planar surface are slideably insertable into and extractable from a Universal Serial Bus port to ensure that no electrical connection is made to the Universal Serial Bus port when the top piece and the tongued planar surface are so inserted.

8 Claims, 11 Drawing Sheets

USB PORT PROTECTOR

FIELD OF THE INVENTION

The present invention relates, in general, to electrical connectors and, more particularly, to a dummy connector.

BACKGROUND OF THE INVENTION

Various connector types are used are used to connect a personal computer to another devices. These connectors include an Ethernet connector, an IEEE 1394 connector, a parallel connector, a serial connector, IBM Personal System 2 (PS/2) connector, a Video Graphics Array (VGA) connector, a Digital Visual Interface (DVI) connector; a Small Computer System Interface (SCSI) connector, a Tip Ring Sleeve (TRS) connector, and a Universal Serial Bus (USB) connector. The devices that these connectors connect to a personal computer include a keyboard, a printer, a disk drive, a portable media player, and a digital camera.

The socket on a personal computer to which a connector may be connected is commonly referred to as a port.

A port on a computer is a known vulnerability due to the extrication of data from the computer or the infiltration of malicious software onto the computer than may occur via the port. Therefore, there is a need for a device that renders a port unusable when a user of a computer desires. The present invention is such a device for a USB port.

U.S. Pat. No. 7,083,438, entitled "LOCKING COVERS FOR CABLE CONNECTORS AND DATA PORTS FOR USE IN DETERRING SNOOPING OF DATA IN DIGITAL DATA PROCESSING SYSTEMS," discloses an L-shaped latch for blocking an open end of a cable. U.S. Pat. No. 7,083,438 is incorporated by reference into the specification of the present invention.

U.S. Pat. No. 7,390,201, entitled "DATA POINT SECURITY LOCK," discloses a plug that is compliant with a connector standard having an aperture to engage a latch in the connector that partially extends through the aperture and locks to the connector. U.S. Pat. No. 7,390,201 is incorporated by reference into the specification of the present invention.

U.S. Pat. No. 7,530,824, entitled "LOCKING SEAL FOR DATA PORTS AND ASSOCIATED METHODS," discloses a one-time use device having a base with side longitudinal slots, a protrusion extending upwardly into the slot, a ramp that slopes upward, and a stop higher than the ramp, where the protrusion prevents the device from being removed intact once inserted into a port. U.S. Pat. No. 7,530,824 is incorporated by reference into the specification of the present invention.

U.S. Pat. No. 7,563,113, entitled "WATERPROOF PLUG FOR DATA PORT OF PORTABLE ELECTRONIC DEVICE," discloses a cover plate, a sealing flange extended from a data port sealing surface of the cover plate, and a water-guiding groove along the sealing flange. U.S. Pat. No. 7,563,113 is incorporated by reference into the specification of the present invention.

SUMMARY OF THE INVENTION

It is an object of the present invention to prevent connection with a Universal Serial Bus (USB) connector port.

It is another object of the present invention to prevent connection with a Universal Serial Bus connector port via a top piece and a tongued planar surface.

The present invention is a USB port protector.

The USB port protector includes a top piece and a tongued planar surface, where the top piece includes a rectangular surface, a rectangular planar surface, a box having an open bottom and an open top, and a shim-like piece.

DETAILED DESCRIPTION OF THE PREFERRED EMBODIMENT

The present invention is a Universal Serial Bus (USB) port protector.

Figure 1:
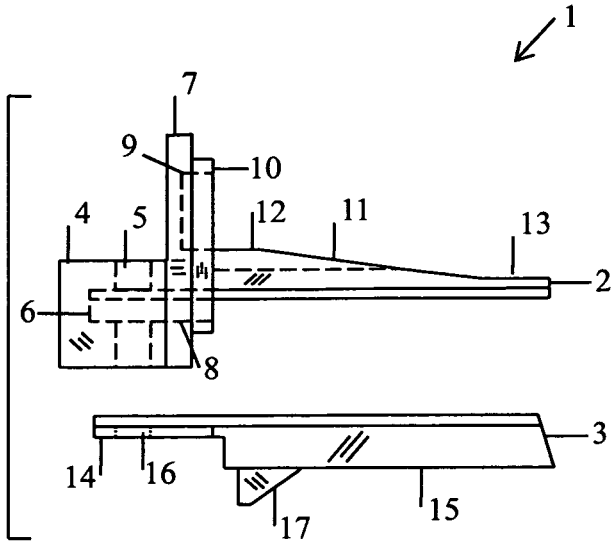
FIG. 1 is a side view of the present invention.

FIG. 1 is a side view of the USB port protector 1 of the present invention. The USB port protector 1 includes a top piece 2 and a tongued planar surface 3.

The top piece 2 includes a rectangular surface 4. The rectangular surface 4 has a user-definable length along an x-axis (going into FIG. 1), a user-definable width along a z-axis (going left to right across FIG. 1), a user-definable height along a y-axis (going from the bottom to the top of FIG. 1), a top, a bottom, and a back. The rectangular surface 4 has a hole 5 of a user-definable diameter extending from the top of the rectangular surface 4 through the bottom of the rectangular surface 4. The rectangular surface 4 also has a blind mortise 6 (i.e., a rectangular cut in an item that does not extend all the way through the item) of a user-definable length in the back of and along the length of the rectangular surface 4. The top piece 2 is comprised of a material selected from the group of materials consisting of plastic, glass, polymer, wood, epoxy, polyurethane, and acrylic resin.

The top piece 2 also includes a rectangular planar surface 7. The rectangular planar surface 7 has a top, a front, a back, and a length equal to the length of the rectangular surface 4. The front of the rectangular planar surface 7 abuts the back of the rectangular surface 4. The rectangular planar surface 7 has a mortise 8 (i.e., a rectangular cut in an item that extends all the way through the item) in the back of the rectangular planar surface 7 that is in alignment with and of the same length as the blind mortise 6 in the rectangular surface 4. The rectangular planar surface 7 also has a blind mortise 9 in the back of the rectangular planar surface 7 proximal to the top of the rectangular planar surface 7 that is not in alignment with but has the same length as the blind mortise 6 in the rectangular surface 4.

The top piece 2 also includes a box 10 of a user-definable height, having an open bottom and an open top, where the bottom of the box 10 abuts the back of the rectangular planar surface 7 so that the mortise 8 and the blind mortise 9 in the rectangular planar surface 7 are enclosed therein.

The top piece 2 also includes a shim-like piece 11, having a top, having a bottom, having a width that is wider than the width of the mortise 8 in the rectangular planar surface 7, having a first edge 12 of a user-definable height, where the top of the shim-like piece 11 slopes from the first edge 12 to a second edge 13 of a lesser user-definable height than the first edge 12, where the first edge 12 of the shim-like piece 11 abuts the back of the rectangular planar surface 7 within the box 10 and between the mortise 8 and the blind mortise 9 of the rectangular planar surface 7, where the top of the shim-like piece 11 has three dados (i.e., a rectangular cut along a length of an item that is contained within the interior of the item) described below and cut therein, and where the bottom of the shim-like piece 11 has two dados and two rabbets (i.e., a rectangular cut along a length and the edge of an item, forming a step-like structure at the edge) described below and cut therein.

The tongued planar surface 3 of the USB port protector 1 has a top and a bottom, has a tongued portion 14, has an untongued portion 15, where the tongued portion 14 extends from the top of the tongued planar surface and has the same width as the mortise 8 in the rectangular planar surface 7, where the un-tongued portion 15 has a user-definably greater width and height than the tongued portion 14, where the tongued portion 14 includes a hole 16 there through that aligns with the hole 5 in the rectangular surface 4 of the top piece 2 when the tongued portion 14 of the tongued planar surface 3 is inserted into the rectangular surface 4 of the top piece 2, having one dado and two rabbets described below cut into the top of the tongued planar surface 3, having two projections 17 extending from the bottom of the untongued portion 15 of the tongued planar surface 3, where the two projections 17 are proximal to the tongued portion 14 of the tongued planar surface 3, where the top piece 2 and the tongued planar surface 3 are slideably insertable into and extractable from a Universal Serial Bus port to ensure that no electrical connection is made to the Universal Serial Bus port when the top piece 2 and the tongued planar surface 3 are so inserted. The tongued planar surface 3 is comprised of a material selected from the group of materials consisting of plastic, glass, polymer, wood, epoxy, polyurethane, and acrylic resin.

The Universal Serial Bus port protector 1 further including a wire (not shown) having a first end and a second end, where the wire is inserted through the hole 5 in the top piece 2 and the hole 16 in the tongued planar surface 3, and where the first end and the second end are securely attached. The wire is comprised of a material selected from the group of materials consisting of copper, steel, nickel, aluminum, plastic, acrylic resin, and polyethylene. The first end and the second end of the wire is secured by a securing method consisting of welding, soldering, cinching, and sintering.

Figure 2:
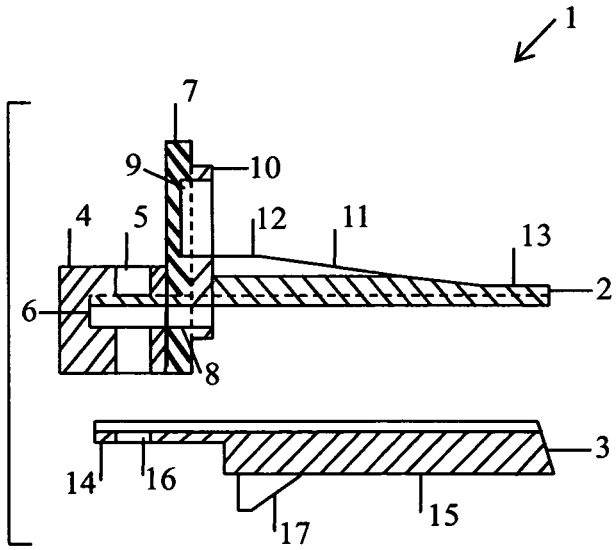
FIG. 2 is a side cross-sectional view of the present invention.

FIG. 2 is a side cross-sectional view of the UB port protector 1 of FIG. 1 showing the top piece 2, the rectangular surface 4, the hole 5 in the rectangular surface 4, the blind mortise 6 in the rectangular surface 4, the rectangular planar surface 7, the mortise 8 in the rectangular planar surface 7, the blind mortise 9 in the rectangular planar surface 7, the box 10, the shim-like piece 11, the tongued planar surface 3, the tongued portion 14 of the tongued planar surface 3, the untongued portion 15 of the tongued planar surface 3, the hole 16 in the tongued planar surface 3, and the two projections 17 in the tongued planar surface 3.

Figure 3A:
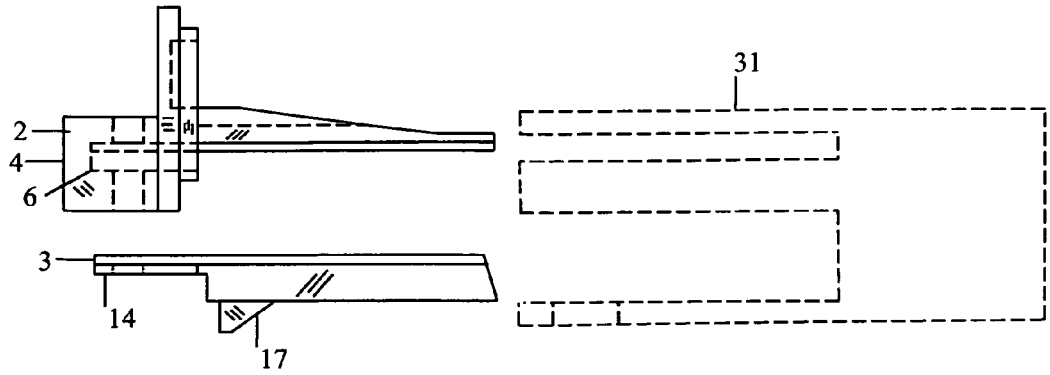
FIGS. 3A-3C are illustrations of the operation of the present invention.
Figure 3B:
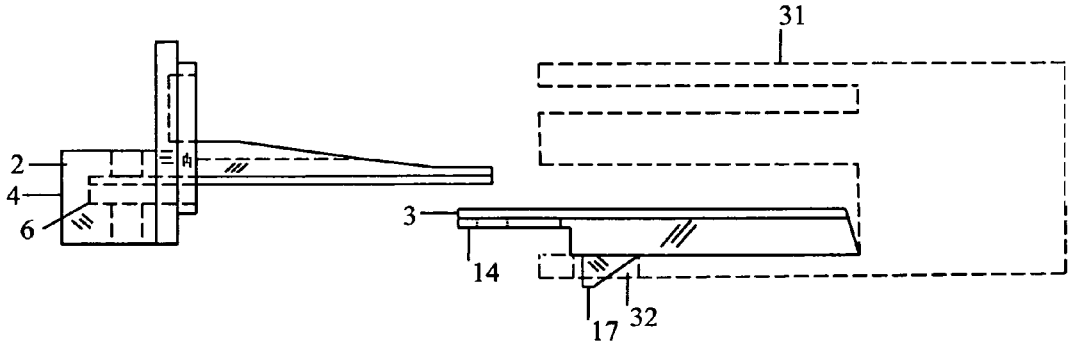
Figure 3C:
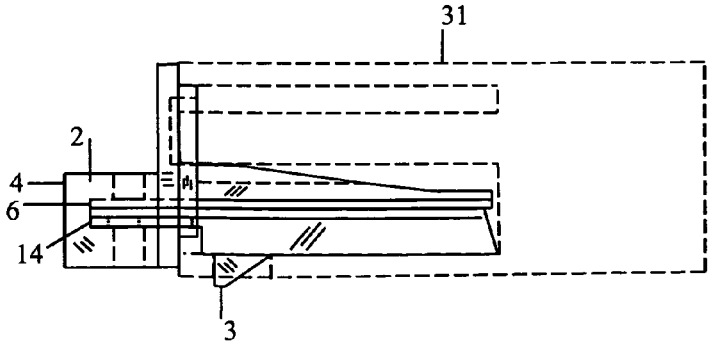

FIGS. 3A-3C are illustrations of the operation of the USB port protector 1. In FIG. 3A, the top piece 2 and the tongued planar surface 3 are separate from a USB port 31. In FIG. 3B, the tongued planar surface 3 is inserted into the USB port 31 so that the two projections 17 of the tongued planar surface 3 are engaged with holes 32 in the USB port 31. In FIG. 3C, the top piece 2 is inserted into the USB port 31 so that the tongued portion 14 of the tongued planar surface 3 is engaged with the blind mortise 6 of the rectangular surface 4 of the top piece 2.

Figure 4:
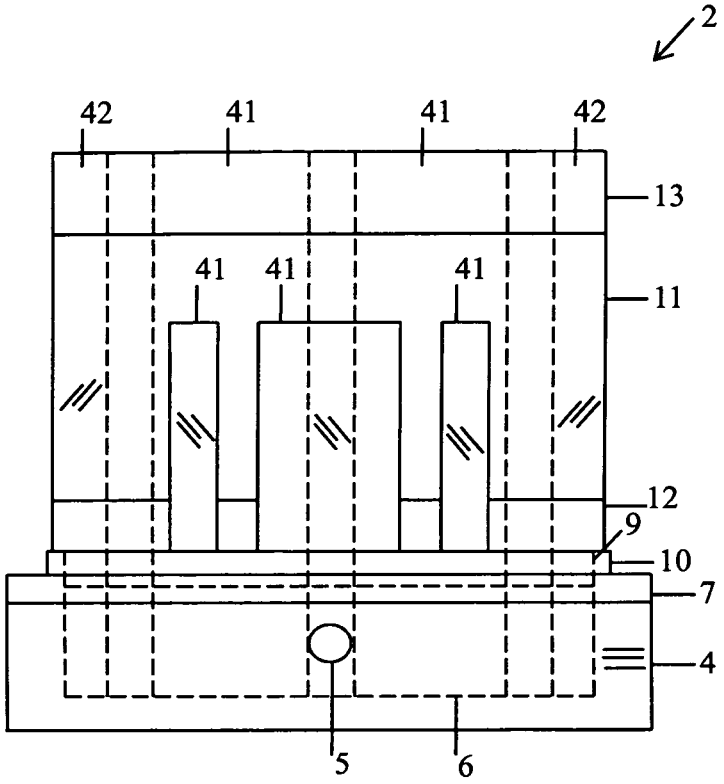
FIG. 4 is a top view of the top piece of the present invention.

FIG. 4 is a top view of the top piece 2 of the USB port protector 1 showing the rectangular surface 4, the hole 5 in the rectangular surface 4, the blind mortise 6 in the rectangular surface 4, the rectangular planar surface 7, the blind mortise 9 in the rectangular planar surface 7, the box 10, the shim-like piece 11, the first edge 12 in the shim-like piece 11, the second edge 13 in the shim-like piece 11, the three dados 41 in the top of the shim-like piece 11, and the two dados 41 and two rabbets 42 in the bottom of the shim-like piece 11.

Figure 5:
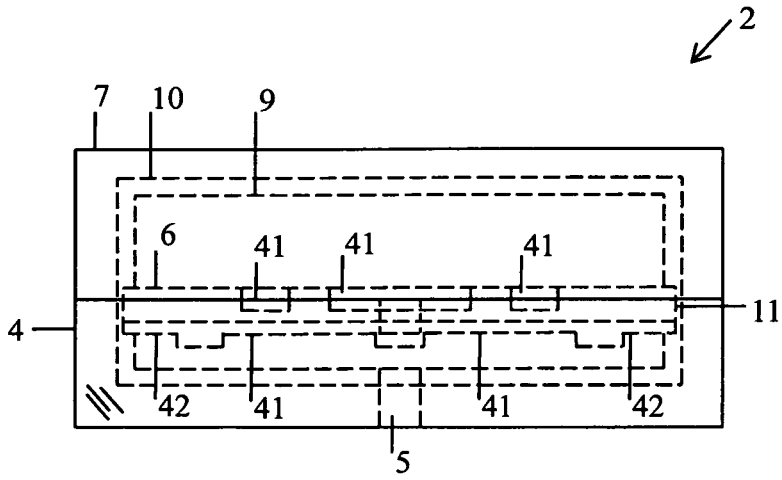
FIG. 5 is a front view of the top piece of the present invention.

FIG. 5 is a front view of the top piece 2 of the USB port protector 1 showing the rectangular surface 4, the hole 5 in the rectangular surface 4, the blind mortise 6 in the rectangular surface 4, the rectangular planar surface 7, the blind mortise 9 in the rectangular planar surface 7, the box 10, the shim-like piece 11, the three dados 41 in the top of the shim-like piece 11, and the two dados 41 and two rabbets 42 in the bottom of the shim-like piece 11.

Figure 6:
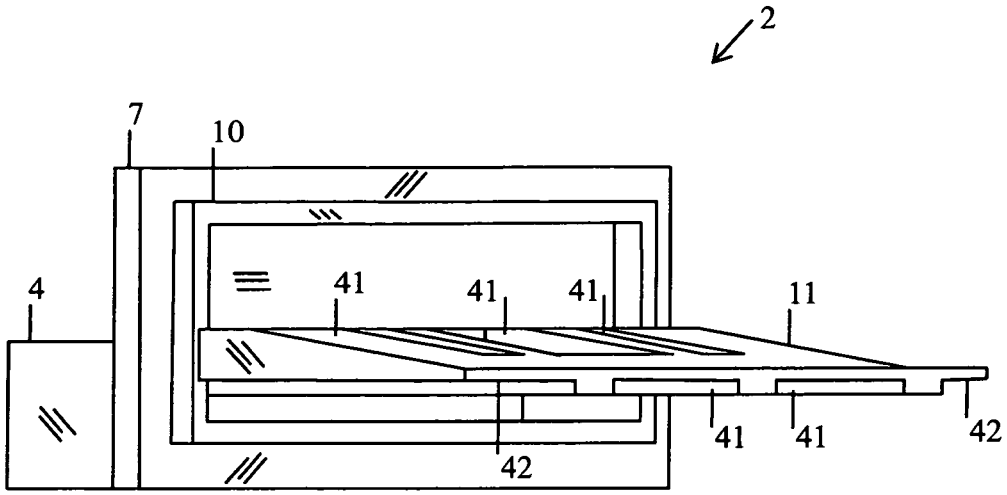
FIG. 6 is a back-side perspective view of the top piece of the present invention.

FIG. 6 is a back-side perspective view of the top piece 2 of the USB port protector 1 showing the rectangular surface 4, the rectangular planar surface 7, the box 10, the shim-like piece 11, the three dados 41 in the top of the shim-like piece 11, and the two dados 41 and two rabbets 42 in the bottom of the shim-like piece 11.

Figure 7:
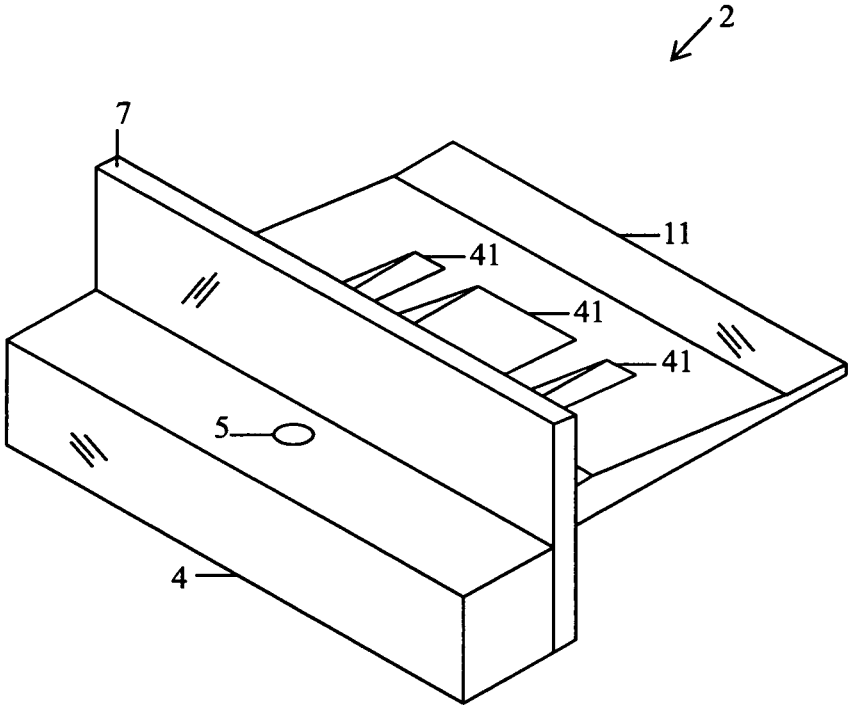
FIG. 7 is a top-side perspective view of the top piece of the present invention.

FIG. 7 is a top-side perspective view of the top piece 2 of the USB port protector 1 showing the rectangular surface 4, the hole 5 in the rectangular surface 4, the rectangular planar surface 7, the shim-like piece 11, and the three dados 41 in the top of the shim-like piece 11.

Figure 8:
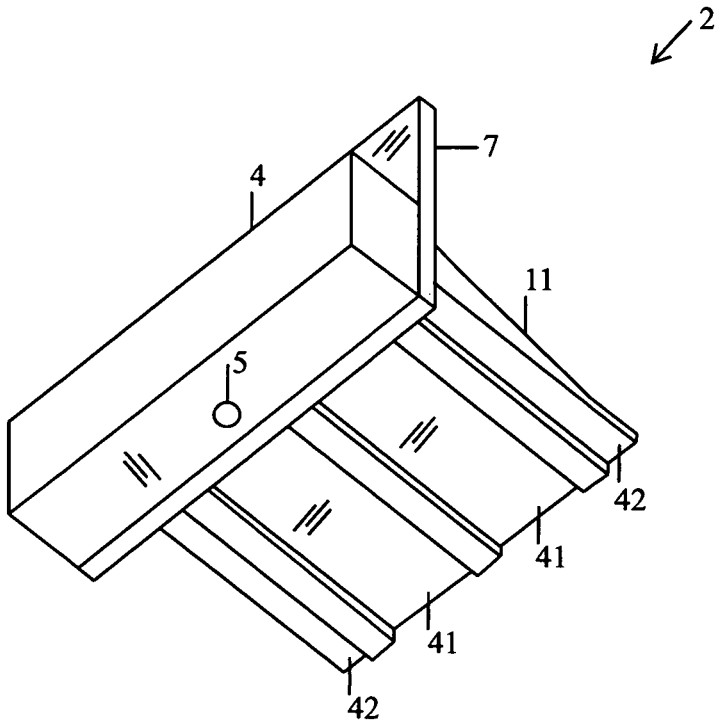
FIG. 8 is a bottom-side perspective view of the top piece of the present invention.

FIG. 8 is a bottom-side perspective view of the top piece 2 of the USB port protector 1 showing the rectangular surface 4, the hole 5 in the rectangular surface 4, the rectangular planar surface 7, the shim-like piece 11, and the two dados 41 and two rabbets 42 in the bottom of the shim-like piece 11.

Figure 9:
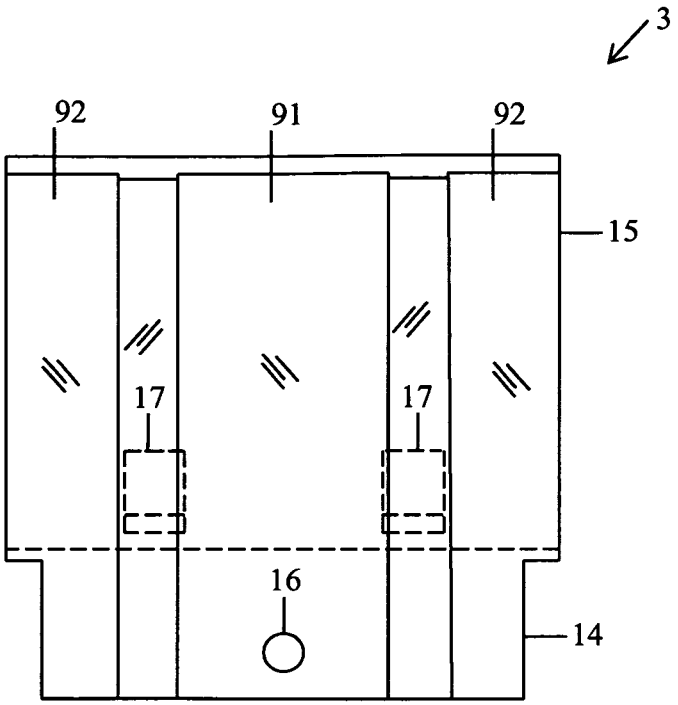
FIG. 9 is a top view of the tongued planar surface of the present invention.

FIG. 9 is a top view of the tongued planar surface 3 of the USB port protector 1 showing the tongued portion 14, the untongued portion 15, the hole 16 in the tongued portion 14 of the tongued planar surface 3, the two projections 17 on the bottom of the untongued portion 15 of the tongued planar surface 3, and the one dado 91 and two rabbets 92 cut into the top of the tongued planar surface 3.

Figure 10:
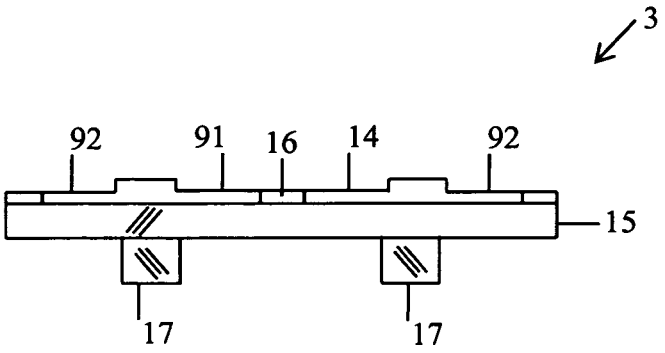
FIG. 10 is a front view of the tongued planar surface of the present invention.

FIG. 10 is a front view of the tongued planar surface 3 of the USB port protector 1 showing the tongued portion 14, the untongued portion 15, the hole 16 in the tongued portion 14 of the tongued planar surface 3, the two projections 17 on the bottom of the untongued portion 15 of the tongued planar surface 3, and the one dado 91 and two rabbets 92 cut into the top of the tongued planar surface 3.

Figure 11:
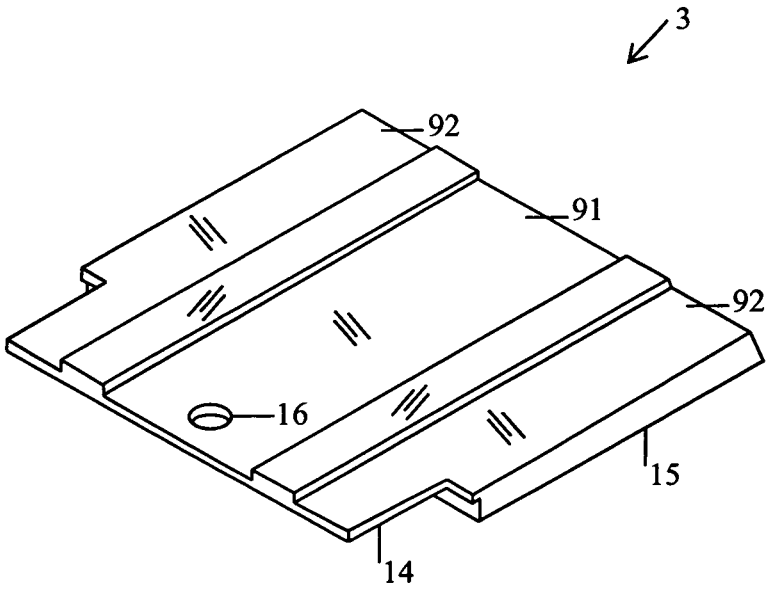
FIG. 11 is a top-side perspective view of the tongued planar surface of the present invention.

FIG. 11 is a top-side perspective view of the tongued planar surface 3 of the USB port protector 1 showing the tongued portion 14, the untongued portion 15, the hole 16 in the tongued portion 15 of the tongued planar surface 3, and the one dado 91 and two rabbets 92 cut into the top of the tongued planar surface 3.

Figure 12:
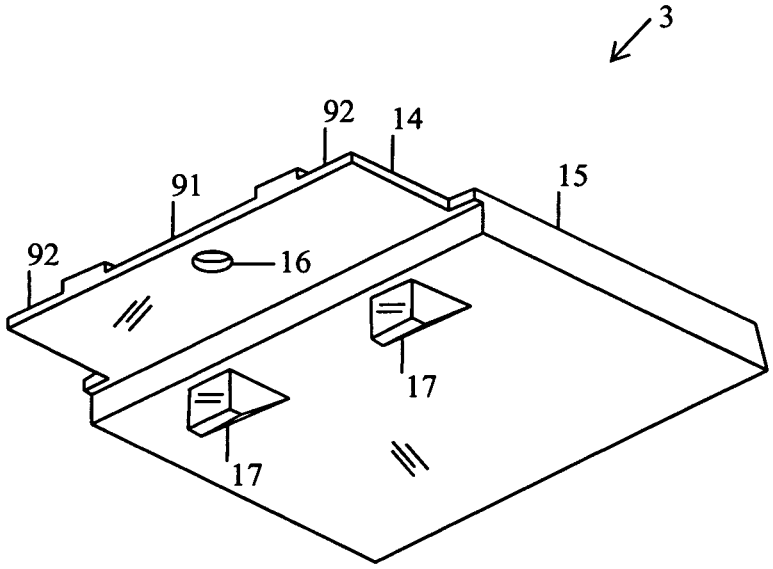
FIG. 12 is a bottom-side perspective view of the tongued planar surface of the present invention.

FIG. 12 is a bottom-side perspective view of the tongued planar surface 3 of the USB port protector 1 showing the tongued portion 14, the untongued portion 15, the hole 16 in the tongued portion 14 of the tongued planar surface 3, the two projections 17 on the bottom of the untongued portion 15 of the tongued planar surface 3, and the one dado 91 and two rabbets 92 cut into the top of the tongued planar surface 3.

What is claimed is:

1. A Universal Serial Bus port protector, comprising:

a) a top piece, comprising:

i) a rectangular surface, having a user-definable length along an x-axis, having a user-definable width along a z-axis, having a user-definable height along a y-axis, having a top, having a bottom, having a back, where a hole of a user-definable diameter extends from the top of the rectangular surface through the bottom of the rectangular surface, and having a blind mortise of a user-definable length in the back of and along the length of the rectangular surface;

ii) a rectangular planar surface, having a top, having a front, having a back, having a length equal to the length of the rectangular surface, where the front of the rectangular planar surface abuts the back of the rectangular surface, having a mortise in the back of the rectangular planar surface in alignment with and of the same length as the blind mortise in the rectangular surface, and having a blind mortise in the back of the rectangular planar surface that is proximal to the top of the rectangular planar surface that is not in alignment with but has the same length as the blind mortise in the rectangular surface;

iii) a box of a user-definable height, having an open bottom and an open top, where the bottom of the box abuts the back of the rectangular planar surface so that the mortise and the blind mortise in the rectangular planar surface are enclosed therein; and iv) a shim-like piece, having a top, having a bottom, having a width that is wider than the width of the mortise in the rectangular planar surface, having a first edge of a user-definable height, where the top of the shim-like piece slopes from the first edge to a second edge of a lesser user-definable height than the first edge, where the first edge of the shim-like piece abuts the back of the rectangular planar surface within the box and between the mortise and the blind mortise of the rectangular planar surface, where the top of the shim-like piece has three dados cut therein, and where the bottom of the shim-like piece has two dados and two rabbet cuts therein; and b) a tongued planar surface, having a top and a bottom, having a tongued portion and an untongued portion, where the tongued portion extends from the top of the tongued planar surface and has the same width as the mortise in the rectangular planar surface, where the untongued portion has a user-definably greater width and height than the tongued portion, where the tongued portion includes a hole there through that aligns with the hole in the rectangular surface of the top piece when the tongued portion of the tongued planar surface is inserted into the rectangular surface of the top piece, having one dado and two rabbet cuts into the top of the tongued planar surface, having two projections extending from the bottom of the untongued portion of the tongued planar surface, where the two projections are proximal to the tongued portion of the tongued planar surface, where the top piece and the tongued planar surface are slideably insertable into and extractable from a Universal Serial Bus port to ensure that no electrical connection is made to the Universal Serial Bus port when the top piece and the tongued planar surface are so inserted.

2. The Universal Serial Bus port protector of claim 1, wherein said top piece and said tongued planar surface are each comprised of a material selected from the group of materials consisting of plastic, glass, polymer, wood, epoxy, polyurethane, and acrylic resin.

3. The Universal Serial Bus port protector of claim 1, further including a wire having a first end and a second end, where the wire is inserted through the holes in the top piece and the tongued planar surface, and where the first end and the second end are securely attached.

4. The Universal Serial Bus port protector of claim 3, wherein the wire is comprised of a material selected from the group of materials consisting of copper, steel, nickel, aluminum, plastic, acrylic resin, and polyethylene.

5. The Universal Serial Bus port protector of claim 3, wherein the first end and the second end of the wire is secured by a securing method consisting of welding, soldering, cinching, and sintering.

6. The Universal Serial Bus port protector of claim 5, further including a wire having a first end and a second end, where the wire is inserted through the holes in the top piece and the tongued planar surface, and where the first end and the second end are securely attached.

7. The Universal Serial Bus port protector of claim 6, wherein the wire is comprised of a material selected from the group of materials consisting of copper, steel, nickel, aluminum, plastic, acrylic resin, and polyethylene.

8. The Universal Serial Bus port protector of claim 7, wherein the first end and the second end of the wire is secured by a securing method consisting of welding, soldering, cinching, and sintering.

* * * * *